US005984344A

United States Patent [19]

Harsányi et al.

[11] Patent Number: 5,984,344

[45] Date of Patent: Nov. 16, 1999

[54] CARRIER ARRANGEMENT FOR A SKI BINDING

[75] Inventors: Otto Harsányi, Murnau; Edwin Lehner, Farchant; Werner Messerschmidt, Garmisch-Partenkirchen, all of Germany; Piero Ruffinengo, Salt Lake City, Utah; Premek Stepanek, Garmisch-Partenkirchen, Germany

[73] Assignee: Marker Deutschland GmbH, Germany

[21] Appl. No.: 09/109,665

[22] Filed: Jul. 2, 1998

Related U.S. Application Data

[62] Division of application No. 08/649,915, May 17, 1996, Pat. No. 5,775,716.

[30] Foreign Application Priority Data

May 17, 1995 [DE] Germany ..... 195 17 417

[51] Int. Cl.[6] ..... A63C 5/07

[52] U.S. Cl. ..... 280/602; 280/607

[58] Field of Search ..... 280/602, 607, 280/618, 601

[56] References Cited

U.S. PATENT DOCUMENTS

| | | |
|---|---|---|
| 5,104,139 | 4/1992 | Brischoux . |
| 5,251,923 | 10/1993 | Stepanek et al. . |
| 5,269,555 | 12/1993 | Ruffinengo . |
| 5,301,976 | 4/1994 | Stepanek et al. . |
| 5,362,085 | 11/1994 | Stepanek et al. . |
| 5,421,602 | 6/1995 | Stepanek et al. . |
| 5,431,427 | 7/1995 | Pieber et al. . |
| 5,437,468 | 8/1995 | Schenner . |
| 5,615,905 | 4/1997 | Stepanek et al. . |

FOREIGN PATENT DOCUMENTS

| | | |
|---|---|---|
| 0 557 737 A2 | 9/1993 | European Pat. Off. . |
| 2 643 430 | 2/1989 | France . |
| 36 28 476 A1 | 2/1988 | Germany . |
| 4041046A1 | 6/1991 | Germany . |
| 92 01 845 U | 3/1993 | Germany . |
| 4321239A1 | 1/1994 | Germany . |
| WO 93/12845 | 7/1993 | WIPO . |
| WO 95/07737 | 3/1995 | WIPO . |

*Primary Examiner*—Lanna Mai
*Assistant Examiner*—Bridget Avery
*Attorney, Agent, or Firm*—D. Peter Hochberg

[57] ABSTRACT

A binding has a carrier arrangement having at least one elongated portion, which extends in the longitudinal direction of the ski, is flexurally rigid and/or can be subjected to shearing. A first region of the carrier arrangement, is fixed to the ski, a second region is spaced apart from said first region in the longitudinal direction of the ski and is coupled, or can be coupled, compliantly to the ski. The carrier arrangement alters the bending properties of the ski to change the stiffness of the ski and/or damp vibrations of the ski.

20 Claims, 6 Drawing Sheets

CARRIER ARRANGEMENT FOR A SKI BINDING

CROSS-REFERENCE TO RELATED APPLICATION

This application is a divisional of U.S. patent application Ser. No. 08/649,915 filed May 17, 1996 now U.S. Pat. No. 5,775,716.

FIELD OF THE INVENTION

The present/invention relates generally to a carrier arrangement for a ski binding, which supports the underside of the ski boot. More particularly, the present invention relates to a carrier arrangement which alters bending properties of the ski in order to stiffen the ski and/or damp vibrations of the ski. The carrier arrangement at least partially absorbs the load of the skier and transfers said load onto the ski. Furthermore, the carrier arrangement has at least one elongated portion which extends in the longitudinal direction of the ski, is flexurally rigid and/or can be subjected to shearing, and has a first region which is fixed to the ski and a second region which is spaced apart from said first region in the longitudinal direction of the ski and is coupled, or can be coupled, compliantly to the ski.

BACKGROUND OF THE INVENTION

Bindings which permit the bending behavior of the ski to be changed are commercially available. For this purpose, one end of an elongated part, which can be subjected to shearing, is arranged on the upper side of the ski, in the central region of the ski, such that it is fixed to said ski. The other end of the elongated part is guided displaceably in the longitudinal direction of the ski and interacts with an adjustable stop.

During "flexing" of the ski, i.e., when the ski ends are bent upward relative to the central region of the ski, the free end of the elongated part is displaced in the direction of the stop. As soon as the elongated part and stop butt against one another, further bending of the ski is counteracted by an increased additional resistance.

Moreover, various ski bindings with carrier plates extending in the longitudinal direction of the ski are already known, these carrier plates being mounted on the ski by a cushion layer consisting of elastomer material of greater or lesser thickness. Some portions of the carrier plates (e.g., a central longitudinal region), may be firmly connected to the ski. The carrier plate serves as a supporting surface for the ski boot, which may be secured releasably on the carrier plate by means of conventional binding elements.

In the case of such bindings, the ski boot is retained at a comparatively large vertical distance from the underside of the ski. Many skiers regard this as advantageous for effective edging. This is because the ski boots are typicall considerably wider than the skis, i.e., the ski boots project over the ski in the sideward direction. When the ski boot is secured at a relatively large vertical distance from the underside of the ski, the ski can then tilt a large degree to the side with respect to the underlying surface. Accordingly, a high degree of edging is possible without a ski-boot region which projects sideward and downward over the tilted ski causing the ski boot to come into contact with the ground.

Furthermore, the elastomer material mentioned above can influence the vibration or bending behavior of the ski and, in particular, can damp vibrations, which task is quite often desired by skiers.

This vibration damping is based, inter alia, on the fact that, during longitudinal bending of the ski, as takes place, for example, when the ski is traveling over dips in the ground, the elastomer material is compressed vertically because the vertical spacing between the carrier plate and the ski is reduced, and/or shearing takes place, because relatively large longitudinal relative movements between the carrier plate and ski take place at a relatively large longitudinal distance from the region of the carrier plate which is fixed to the ski.

SUMMARY OF THE INVENTION

The present invention is based on the general idea of controlling the bending properties of the ski differently depending on the way in which it is running (e.g., flexing, counterflexing, turning, straight travel, etc.), in that the relative movements between an elongated part mounted to the ski and the ski itself are controllable.

The present invention takes into account, in particular, that, when the ski is traveling quickly through extended curves, a more rigid ski is generally desired than when it is traveling quickly straight ahead. When traveling straight ahead, a ski with an easily bendable tip is preferred, while when traveling quickly through curves, when the ski is edged to a pronounced extent, considerably greater resilient rigidity is desired in order to ensure that the ski edges in the front and rear end regions of the ski also have a greater load-bearing force.

Moreover, according to a preferred embodiment of the present invention, the bending behavior of the ski is controlled in a frequency-selective manner in order to avoid undesired resonant vibrations. For this purpose, the damping action of the coupling between the elongated part and the ski is increased in the event of the occurrence of critical vibrations.

According to a preferred embodiment of the present invention, intercommunicating hydraulic displacement units comprised of at least two intercommunicating hydraulic chambers are provided. Each hydraulic chamber changes its volume oppositely with respect to the other hydraulic chamber. In this respect, one hydraulic chamber reduces its volume, while the other hydraulic chamber increases its volume. Hydraulic medium is exchanged between the chambers through a connecting part arranged therebetween. In this arrangement, the medium exchanged between chambers is subject to control. Preferably, use is made of a hydraulic media with a viscosity which can be changed in a magnetoelectrical manner. Accordingly, the flow of fluid through the connecting part between the hydraulic chambers is changeable by controlling electromagnetic fields.

According to the present invention, there is provided a system for modifying the bending properties of a ski having a central region, a forward end and a rearward end. The system is comprised of support means for supporting a ski boot on the ski including a first portion fixed to the ski, and at least one elongated portion extending from the first portion in the longitudinal direction of the ski. A recess is formed between the ski and the at least one elongated portion to allow the ski to move relative to the at least one elongated portion as the ski bends. Impedance means impede movement of the ski relative to the at least one elongated portion as the ski bends.

Further, according to the present invention, there is provided a system for modifying the bending properties of a ski having a central region, a forward end and a rearward end. The system is comprised of support means for supporting a ski boot on a ski including a longitudinally extending tongue member having a first portion fixed to the ski, and at least one free end movable relative to the ski in the longitudinal direction of the ski as the ski bends. The system also includes impedance means for impeding the movement of the at least one free end relative to the ski as the ski bends.

It is an object of the present invention to provide a carrier arrangement which at least partially absorbs the load of the skier and transfers said load onto the ski.

It is another object of the present invention to provide a carrier arrangement which modifies the bending properties of a ski in order to stiffen the ski and/or damp vibrations of the ski.

It is another object of the present invention to provide a carrier arrangement having an impedance member to impede bending movements of a ski.

It is still another object of the present invention to provide a carrier arrangement which controls the bending properties of a ski differently depending upon the way the ski is running.

It is yet another object of the present invention to provide a carrier arrangement which effects the bending properties of a ski in a frequency-selective manner in order to avoid undesirable resonant vibrations of the ski.

It is still another object of the present invention to provide a carrier arrangement having a flexurally rigid carrying plate for a ski boot, wherein the vertical relative movement between parts of the carrying plate and the ski are subject to control.

It is still another object of the present invention to provide a carrier arrangement having an elongated part extending in the longitudinal direction of the ski, wherein longitudinal relative movement between the ski and the elongated part is subject to control.

It is still another object of the present invention to provide a carrier arrangement which can control the elasticity and/or damping rate of the ski in a parameter-dependent manner.

These and other objects will become apparent from the following description of preferred embodiments taken together with the accompanying drawings and the appended claims.

BRIEF DESCRIPTION OF THE DRAWINGS

The invention may take physical form in certain parts and arrangement of parts, preferred embodiments of which will be described in detail in the specification and illustrated in the accompanying drawings which form a part hereof, and wherein.

DETAILED DESCRIPTION OF THE PREFERRED EMBODIMENTS

Figure 1:
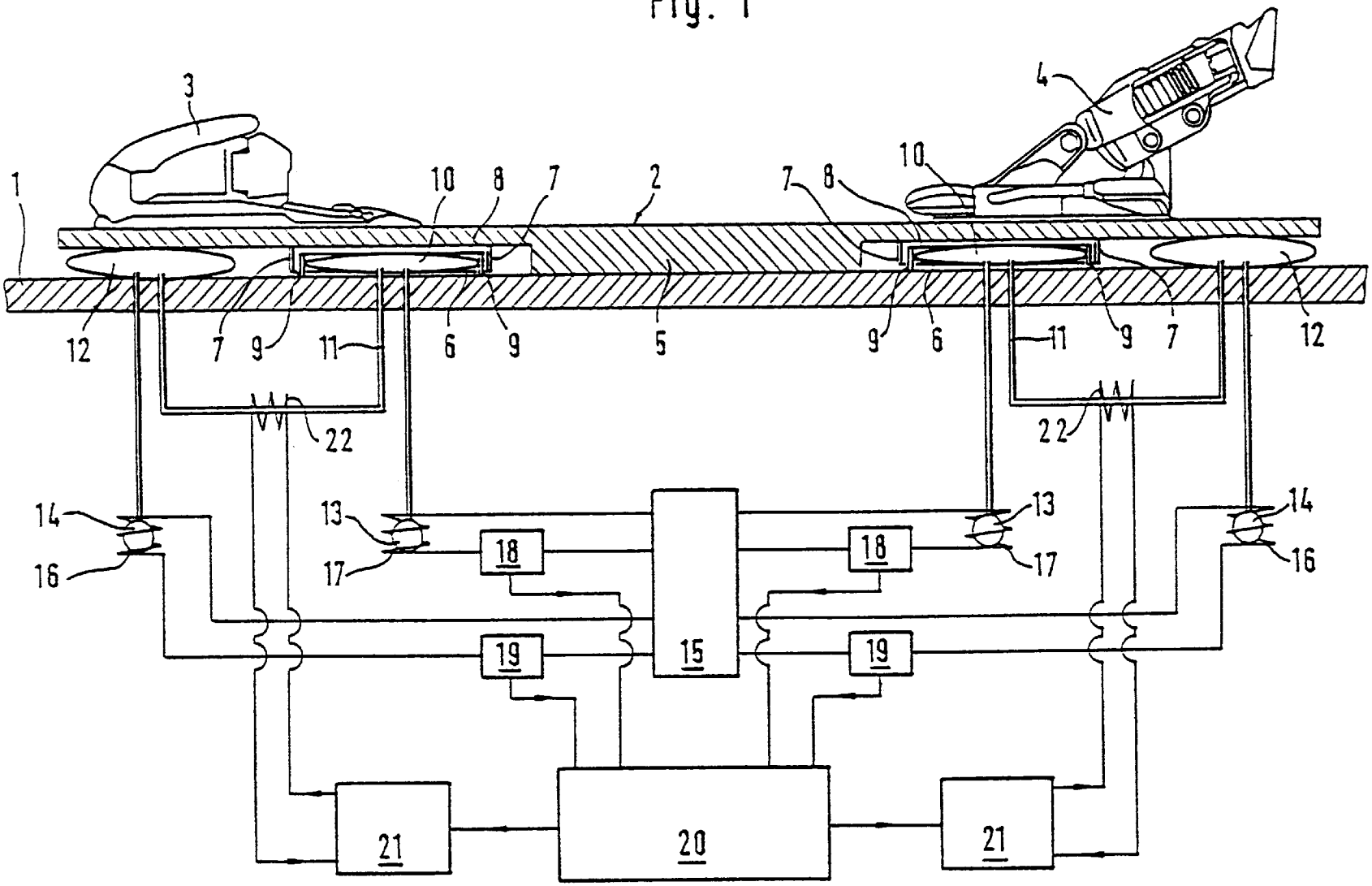
FIG. 1 is a side view and schematic of a carrier arrangement illustrating a first preferred embodiment of the present invention.

Referring now to the drawings wherein the showings are for the purpose of illustrating preferred embodiments of the invention only, and not for the purpose of limiting same, in FIG. 1, a ski 1, sections of which are represented in side view, has arranged on it a flexurally rigid carrying plate 2 which extends in the longitudinal direction of the ski and bears a conventional ski binding having a front binding part 3 for securing the front end of the ski-boot sole and a rear binding part 4 for securing the rear end of the ski-boot sole.

In its central section, carrying plate 2 has, on its underside, a support portion 5 which is essentially fixed to the ski. Carrying plate 2 also has forward and rearward end sections, which respectively project outward from said support portion 5, in the forward and rearward direction of the ski, to a comparatively large extent.

In the recesses between the projecting sections of carrying plate 2 and ski 1, in each case in a region adjoining support portion 5, there is arranged, on carrying plate 2, a first retaining plate 6 which is spaced apart from the underside of said carrying plate 2 and from the upper side of the ski 1 and is secured on carrying plate 2 by means of struts 7. Retaining plate 6 may, for example, be of an essentially rectangular form, and struts 7 are each fastened at the corners of the rectangle.

A second retaining plate 8 is fastened in each case in a similar manner on the upper side of ski 1 by means of struts 9. In the depicted example, retaining plate 8 is somewhat shorter, in the longitudinal direction of the ski, than retaining plate 6, but is of a somewhat greater dimension in the transverse direction of the ski. Accordingly, struts 9 of retaining plate 8 may be arranged laterally beside retaining plate 6, at the corners of retaining plate 8, and can retain retaining plate 8, in the clearance between the underside of carrying plate 2 and retaining plate 6, at a spacing from the underside of carrying plate 2.

Arranged in each case between retaining plates 6 and 8 is a first hydraulic chamber 10, the chamber wall of which is designed flexibly and compliantly in the manner of a bellows. Hydraulic chamber 10 communicates, in each case via a channel 11, with a second hydraulic chamber 12, which is arranged in each case beneath the front or rear end sections of carrying plate 2, between the underside thereof and the upper side of ski 1, and likewise has a wall designed in the manner of a bellows.

For clarity of the illustration, channel 11 is represented beneath ski 1 in each case. In reality, channel 11 is arranged in a recess on the underside of carrying plate 2.

Furthermore, the two hydraulic chambers 10 and 12 are each connected to an associated chamber 13 and 14, respectively, these having elastically compliant walls and, similarly to channels 11 (but differing from the representation in FIG. 1) being accommodated in recesses of carrying plate 2.

When ski 1 "flexes," i.e., when the ski ends bend in the upward direction relative to the central region of the ski, the vertical spacing between the upper side of ski 1 and the underside of carrying plate 2 is reduced, with the result that hydraulic chambers 12 are compressed. This results in hydraulic medium being displaced out of chambers 12 into associated chambers 14.

Simultaneously with the bending of ski 1, the vertical spacing between retaining plates 6 and 8 is increased, with the result that the volume of hydraulic chambers 10 is increased and hydraulic medium flows out of associated chambers 13 into hydraulic chambers 10. Moreover, hydraulic flow from hydraulic chambers 12 to hydraulic chambers 10 takes place.

When ski 1 "counterflexes," i.e., when the ski ends bend in the downward direction relative to the central region of ski 1, the volume of hydraulic chambers 12 increases, while the volume of hydraulic chambers 10 decreases. Accordingly, hydraulic medium will be displaced out of hydraulic chambers 10 into associated chambers 13. Moreover, there will be a flow of hydraulic medium from associated chambers 14 to hydraulic chambers 12 and from hydraulic chambers 10 to hydraulic chambers 12.

The hydraulic flows described above are subjected to control in a manner explained hereinbelow. According to a first preferred embodiment of the present invention, use is made of a hydraulic media which has pronounced magnetoviscosity, i.e., becomes very viscous under the influence of magnetic fields. A high-frequency generator 15 is accommodated in a cavity of support portion 5, and said generator provides coils 16 and 17 with a high-frequency electric current. Said coils 16 and 17 enclose associated chambers 13 and 14. Depending on the quantity of hydraulic medium received by associated chambers 13 and 14, there is a change in the electrical impedance of the electric current paths between the connections of coils 16 and 17 at the high-frequency generator 15. These changes in electrical impedance are determined by impedance networks 18 and 19 which, accordingly, pass different signals to associated inputs of an electronic processor 20. The latter controls two electric power stages 21, which each provide one of coils 22, which enclose channels 11, with electric current. Depending on the size of the electric current, coils 22 produce a magnetic field of different strength in channels 11, with the result that the viscosity of the hydraulic medium in channels 11 change correspondingly. In the case of relatively strong magnetic fields, the hydraulic medium can become so viscous that it can no longer flow through channels 11, or can flow through them only with difficulty. In this manner, the connection between hydraulic chambers 10 and 12 can thus be "opened" and/or "closed."

The preferred manner of operating the depicted system will now be described. When the ski is traveling through a curve, the skier tilts and digs uses the edges, into the snow to the extent required according to the direction and curvature of the curve ski 1 bends to a more or less pronounced extent because the centrifugal forces caused by the skier act predominantly in the central region of ski 1. As a result of this bending of ski 1, the volume of hydraulic chambers 12 is reduced, hydraulic medium being displaced into associated chambers 14, with the result that the impedance of coils 16 is increased. At the same time, the volume of hydraulic chambers 10 is increased, hydraulic medium flowing out of associated chambers 13 into chambers 10, with the result that the impedance of coils 17 is reduced. By means of the impedance networks 18 and 19, processor 20 recognizes the above-mentioned hydraulic-medium displacement which is characteristic of the flexinig of ski 1. Thereupon, the power stages 21 are activated by processor 20 such that they provide coils 22 with a comparatively large electric current. Due to the strong magnetic field which then takes effect in channels 11, the hydraulic medium in said channels 11 becomes viscous, i.e., channels 11 are "closed off," with the result that virtually no hydraulic medium can be exchanged between hydraulic chambers 10 and 12, and the upward movement of ski 1 relative to carrying plate 2 is counteracted by a comparatively strong resistance. Accordingly, ski 1 is stiffened.

Processor 20 "detects" a counterflex occurring after the ski has traveled through a curve because the impedance of the two coils 17 is then increased, while the impedance of two coils 16 is reduced. In this regard, hydraulic medium flows out of hydraulic chambers 10 into associated chambers 13, while hydraulic medium flows out of associated chambers 14 into hydraulic chambers 12. Since there is to be no obstruction to ski 1 bending back after it has traveled through a curve, processor 20 switches off power stages 21, with the result that the magnetic field of coils 22 is eliminated and the hydraulic medium in channels 11 returns to low-viscosity form again. Accordingly, hydraulic medium can be freely exchanged between hydraulic chambers 10 and 12, and ski 1 can be bent back mainly without resistance.

When ski 1 is traveling quickly straight ahead, and glides over an unevenness in the ground, first of all, the front end of ski 1 is deflected vertically, and then, at a time interval which is dependent on the traveling speed, there is a corresponding deflection of the rear end of ski 1. Here, processor 20 detects that the signals of impedance networks 18 and 19, which are assigned to the front ski end and the signals of impedance networks 18 and 19 , which are assigned to the rear end of ski 1, produce identical signals with a temporal phase displacement, i.e., signals which are not simultaneous. Such phase-displaced signals are unheeded by processor 20, i.e., power stages 21 remain switched off, with the result that coils 22 do not produce any magnetic fields and the hydraulic medium in channels 11 remains in low-viscosity form. Accordingly, the movements of ski 1 relative to carrying plate 2 remain virtually unaffected.

Similarly, the processor 20 can detect if the signals of impedance networks 18 and 19 (front end of ski) and the signals of impedance networks 18 and 19 (rear end of ski) indicate that each end of the ski is simultaneously moving in an opposite direction relative to the central region of the ski. As a result, processor 20 can place power stages 21 in an off condition, thus not altering movements of ski 1 relative to carrying plate 2.

Figure 2:
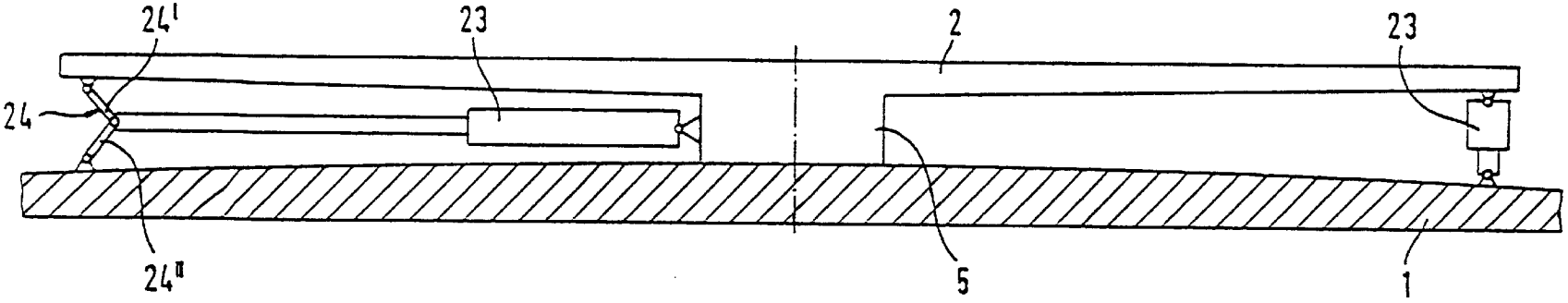
FIG. 2 is a side view of a carrier arrangement according to a second and a third preferred embodiment of the present invention.

FIG. 2 illustrates two additional embodiments of the present invention. In this respect, FIG. 2 shows two different arrangements which effect bending of the ski. According to the right-hand part of FIG. 2, a preferably controllable shock absorber 23 is vertically arranged between the rear end and/or front end of carrying plate 2 and ski 1. According to the left-hand half of FIG. 2, a toggle-joint arrangement 24 is arranged between the free end of carrying plate 2 and the upper side of ski 1, said arrangement having a lever 24' which can be pivoted on carrying plate 2, about a transverse axis of the ski, and a lever 24" which is fitted on ski 1 and can be pivoted about a transverse axis of the ski, the two levers being connected to one another in an articulated manner in the form of a toggle joint. A horizontally arranged shock absorber 23 is connected at one end to the toggle joint in an articulate manner, and at the other end of which is articulated to support portion 5.

Vertical vibrations of ski 1 relative to carrying plate 2 can be damped in a controllable manner by the two arrangements represented in FIG. 2. Toggle-joint arrangement 24 produces a non-linear relationship between the stroke of shock absorber 23, on the one hand, and the change in the spacing between ski 1 and carrying plate 2, on the other hand. Due to the large opening angle which levers 24' and 24" form with one another, the horizontally arranged shock absorber 23, first of all, executes a relatively large stroke when ski 1 approaches carrying plate 2 by a relatively small amount. When ski 1 approaches carrying plate 2 further, shock absorber 23 then executes a comparatively small further stroke.

It should be appreciated that shock absorbers 23 can act differently, depending on the movement direction. This makes it possible, for example, for bending of ski 1 to be counteracted by a smaller resistance than the subsequent bending-back movement of ski 1. This is synonymous with shock absorbers 23 operating with lower resistance in the compression direction (compression stage) than in the tension direction (tension stage).

Figure 3:
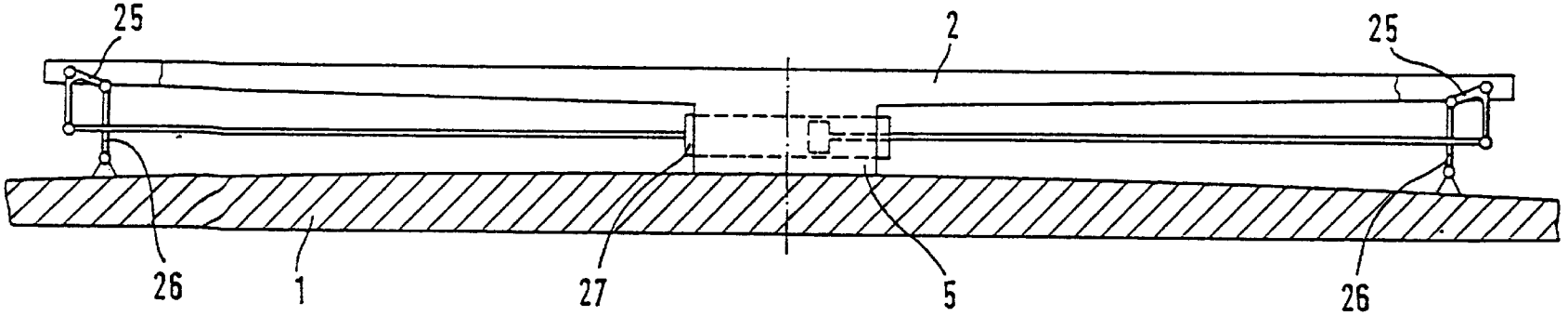
FIG. 3 is a side view of a carrier arrangement according to a fourth preferred embodiment of the present invention.

FIG. 3 illustrates another embodiment of the present invention, wherein double-arm levers 25 are arranged at each end of carrying plate 2 such that they can be pivoted about transverse axes of the ski. The lever arms of double-arm levers 25 approximately form a right angle. The shorter, essentially approximately horizontally arranged lever arm is connected in an articulated manner to one end of a link 26, the other end of which is articulated to ski 1. The other lever arm is connected in an articulated manner to the piston rod of an approximately horizontally arranged controllable shock absorber 27. By virtue of the arms of double-arm lever 25 being of different lengths, a transmission is achieved, i.e., changes in spacing between ski 1 and carrying plate 2 are transmitted into a comparatively large stroke of the piston rod of shock absorber 27.

Figure 4:
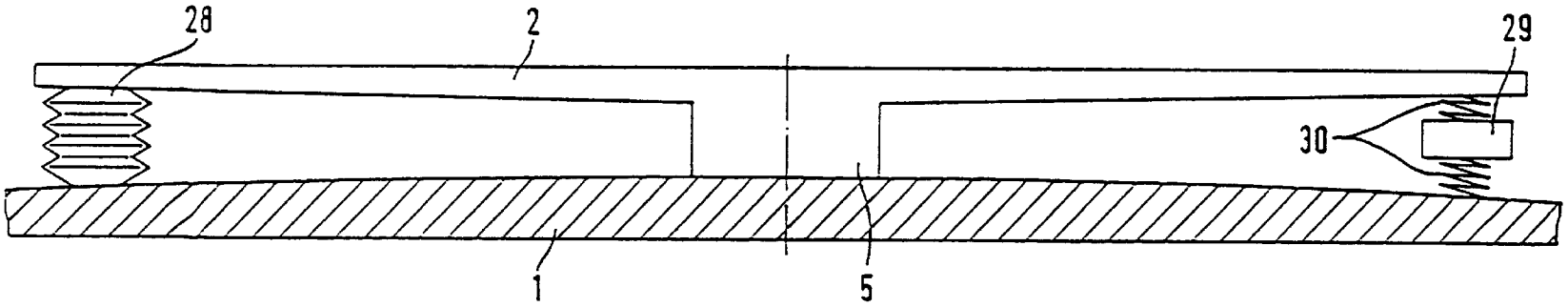
FIG. 4 is a side view of a carrier arrangement according to a fifth and a sixth preferred embodiment of the present invention.

FIG. 4 shows two additional embodiments of the present invention. The left-hand part of FIG. 4 shows the arrangement of a so-called air damper 28 between ski 1 and carrying plate 2. Air damper 28 is an air-filled or gas-filled bellows consisting of elastomer material. The right-hand part of FIG. 4 shows an absorption mass 29 between ski 1 and carrying plate 2. In this arrangement, a body, forming an absorption mass 29 of a predetermined inert mass, is coupled at one end to ski 1 and on the other end to carrying plate 2, by means of helical springs 30 or the like, so as to be capable of vibration. By measuring the springing characteristics of helical springs 30 and the magnitude of the inert mass of the absorption mass, a highly frequency-selective behavior can be achieved such that vibrations of ski 1 relative to carrying plate 2 are counteracted by a comparatively large resistance at predetermined frequencies. This is based on the fact that counter-vibrations can be induced in absorption mass 29.

Figure 5:
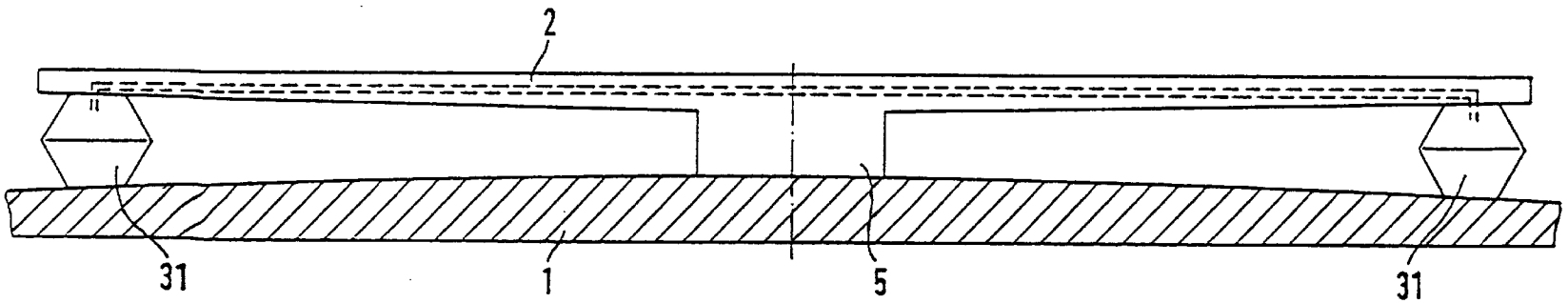
FIG. 5 is a side view of a carrier arrangement according to a seventh preferred embodiment of the present invention.

FIG. 5 shows another embodiment of the present invention for modifying bending properties of the ski. In this embodiment, bellows 31 are arranged between the ends of carrying plate 2 and ski 1, these bellows being connected fluidically to one another and having elastically compliant walls, for example consisting of elastomer material. The bellows 31 are connected by a channel formed in carrying plate 2.

The fluidic connection of bellows 31 achieves the situation where one bellows 31 tries to force the associated end of ski 1 away from carrying plate 2 when ski 1 approaches carrying plate 2 in the region of the other bellows 31. This means that, even when the skier leans forward to a pronounced extent, i.e., when the weight of the skier is shifted in the forward direction, a comparatively high loading of the rear end of the ski is achieved. Moreover, the fluidic connection achieves the situation where two bellows 31 act with a relatively high degree of rigidity when the two ski ends try to approach carrying plate 2 simultaneously. When ski 1 is traveling through a curve, it becomes relatively rigid (i.e., increased stiffness), while it remains more compliant (i.e., decreased stiffness) when it is traveling straight ahead.

Figure 6:
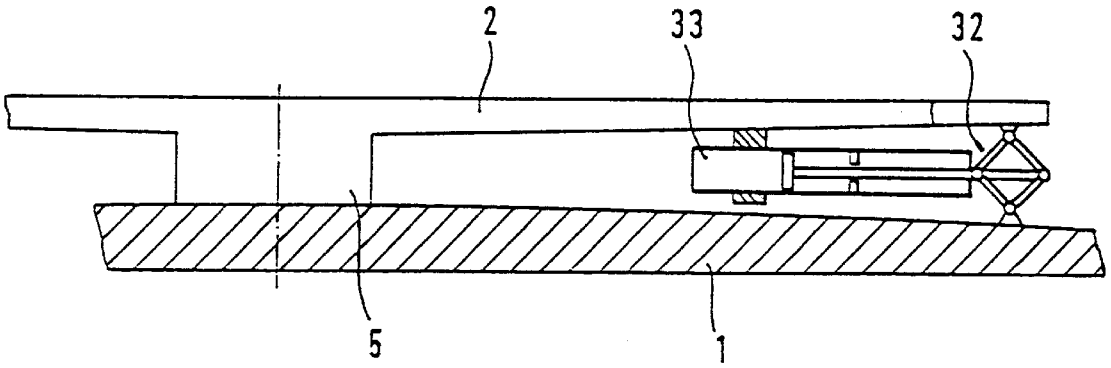
FIG. 6 is a partial side view of a carrier arrangement according to an eighth preferred embodiment of the present invention.

In the embodiment shown in FIG. 6, a parallelogram linkage 32 is arranged between ski 1 and carrying plate 2 such that one diagonal of the parallelogram runs approximately vertically and the other diagonal runs approximately horizontally. The joints of parallelogram linkage 32 on the horizontal diagonal are connected, on the one hand, to the cylinder and, on the other hand, to the piston rod of a preferably controllable shock absorber 33 which, accordingly, is subjected to tensile loading (tension stage) when the spacing between ski 1 and carrying plate 2 is reduced.

When ski 1 is in the normal position relative to carrying plate 2 (FIG. 6), the horizontal diagonal of parallelogram linkage 32 is shorter than the vertical diagonal. As ski 1 first approaches carrying plate 2 from its normal position, shock absorber 33 executes fairly large strokes in the tension direction. As ski 1 approaches carrying plate 2 further, the strokes of shock absorber 33 then become increasingly shorter.

Figure 7:
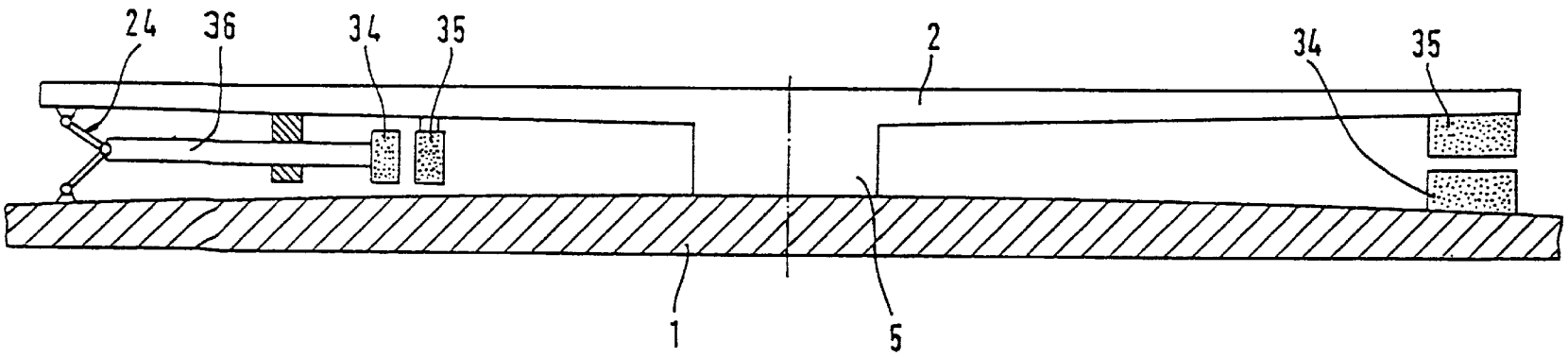
FIG. 7 is a side view of a carrier arrangement according to a ninth and a tenth preferred embodiment of the present invention.

FIG. 7 shows embodiments of the present invention, wherein magnet elements are used for damping the relative movements between ski 1 and carrying plate 2. In the right-hand part of FIG. 7, a first permanent magnet 34 is arranged on ski 1 and a second permanent magnet 35 is arranged on carrying plate 2. The two magnets 34 and 35 face one another with magnet poles of the same polarity and a relatively large spacing remains between magnets 34 and 35 in the normal position of ski 1. When ski 1 approaches carrying plate 2, the repelling forces acting between magnets 34 and 35 increase progressively. In the left-hand part of FIG. 7, a toggle joint arrangement 24 is, once again, arranged between ski 1 and carrying plate 2, the toggle joint of which is connected in an articulated manner to a push rod 36, which is secured in a movable manner in a slide guide on carrying plate 2. A first permanent magnet 34 is arranged on push rod 36, and a second permanent magnet 35 is fastened on carrying plate 2. Magnets 34 and 35 face one another with identical magnet poles and, in the depicted normal position of ski 1 relative to carrying plate 2, are spaced apart by a relatively large horizontal space, which is reduced when the spacing between ski 1 and carrying plate 2 is reduced. In the process, a progressively increasing repelling force occurs, in turn, between magnets 34 and 35.

Figure 8:
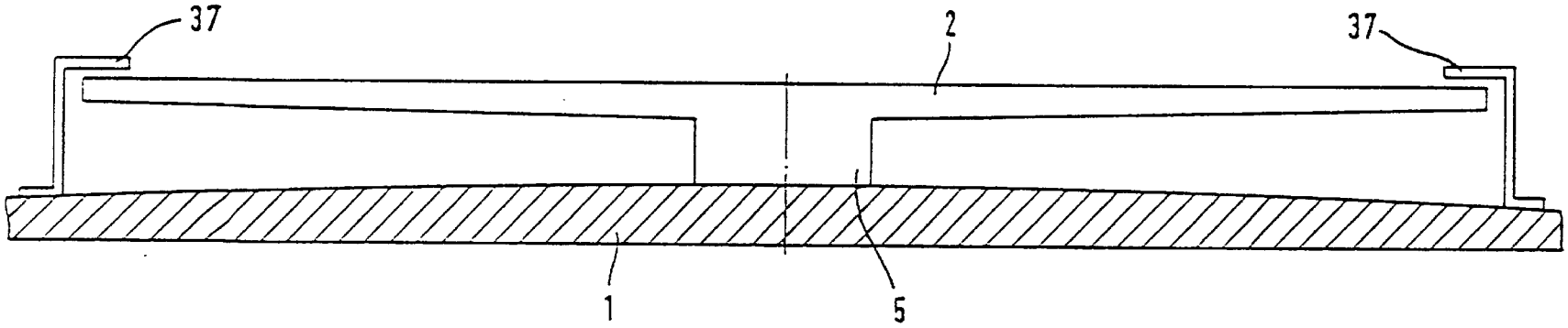
FIG. 8 is a side view of a carrier arrangement according to an eleventh preferred embodiment of the present invention.

Referring now to FIG. 8, there is shown yet another embodiment of the present invention. In FIG. 8, stops 37 are arranged on ski 1, said stops interacting with the front and rear ends of carrying plate 2 such that a possible increase in the spacing between ski 1 and carrying plate 2 is restricted. This is synonymous with the counterflex of ski 1 which follows flexing of ski 1. In this embodiment, the upward bending of the two ski ends with respect to the central region of ski 1, is restricted. Consequently, the possible flexing of ski 1 is considerably greater than the possible counterflexing.

Figure 9:
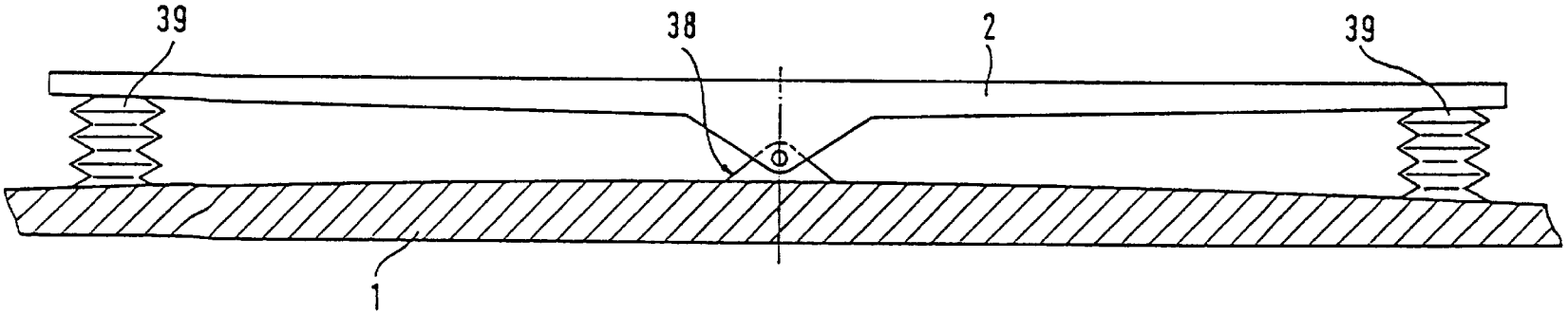
FIG. 9 is a side view of a carrier arrangement according to a twelfth preferred embodiment of the present invention.

In the embodiments shown in FIGS. 1–8, carrying plate 2 is, in each case, arranged on ski 1 by means of a support portion 5. Accordingly, the central region of ski 1 is connected to carrying plate 2 in the region of support portion 5 such that it cannot tilt. In the embodiment of FIG. 9, on the other hand, carrying plate 2 is secured on ski 1 in the central region such that it can pivot about a transverse axis of the ski. For this purpose, carrying plate 2 and ski 1 are connected to one another by means of a hinge-like joint 38. Spring and damper elements 39 are arranged in each case between the ends of carrying plate 2 and ski 1, and these elements endeavor to retain carrying plate 2 in the depicted normal position relative to ski 1.

If the front and rear regions of ski 1 are moved in mutually opposite directions relative to carrying plate 2, spring and damper elements 39 act in a comparatively pliable manner because one of said elements is subjected to compressive loading and the other element is subjected to tensile loading. If, on the other hand, ski 1 tries to bend, for example when it is traveling through a curve, and accordingly, the two ski ends simultaneously try to reduce their spacing from carrying plate 2, said bending is counteracted by an increased resistance because the two spring and damper elements 39 are simultaneously subjected to compressive loading. Consequently, the ski has relatively pliable characteristic (i.e., reduced stiffness) when it is traveling straight ahead, while the ski has more rigidity (i.e., increased stiffness) when it is traveling through curves.

Figures 10, 11:
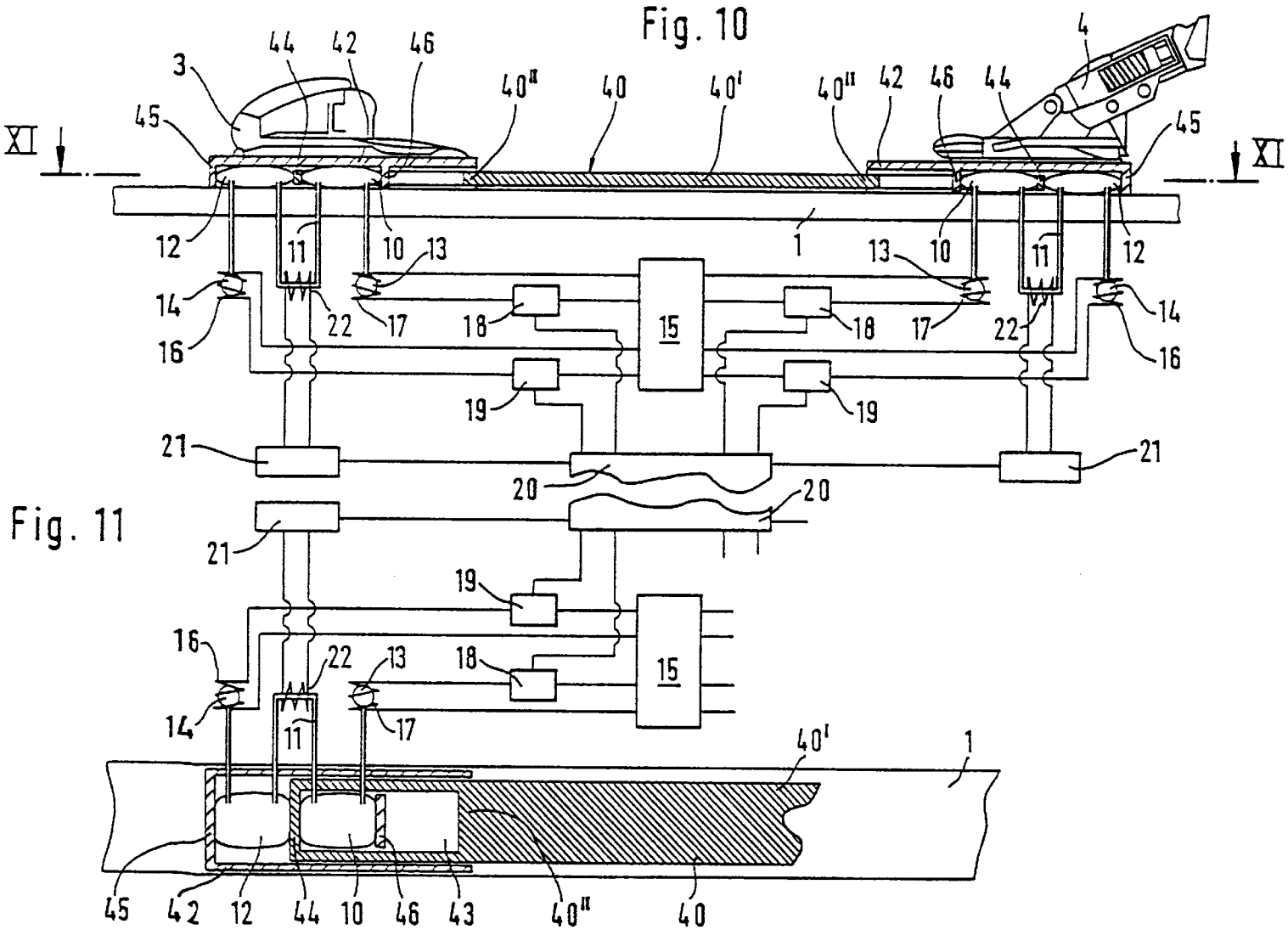
FIG. 10 is a side view and schematic of a carrier arrangement according to a thirteenth preferred embodiment of the present invention.
FIG. 11 is a top sectional view taken along XI—XI of FIG. 10, and a schematic.

FIGS. 10 and 11 show still another preferred embodiment of the present invention. FIG. 10 shows a vertical longitudinal section and FIG. 11 shows a horizontal section corresponding to the section line XI—XI in FIG. 10. In this embodiment, a flat-band-like tongue 40 is arranged in a central region of ski 1, on the upper side thereof, and said tongue is fixed to the upper side of ski 1 in a region 40' and extends in the longitudinal direction of the ski. Tongue 40 is of a sectional or, preferably, flexible design, such that it can be adapted to the flexing and counterflexing of ski 1, it being ensured, by one or more longitudinal guide elements arranged on the ski that tongue 40 continues to lie on ski 1 when the latter bends. Moreover, tongue 40 is designed such that it can absorb large tensile and shear forces.

A region 40" remote from the region 40' of the tongue 40 is guided, so as to be displaceable in the longitudinal direction of the ski, in a housing 42 which is essentially fixed to the ski. Region 40" has a rectangular recess 43 which is delimited at the free end of tongue 40 by a transverse member 44 formed thereon.

In front of and behind transverse member 44 in the longitudinal direction of the ski, transverse bars 45 and 46 are fixedly arranged on housing 42 (or on ski 1), the transverse bar 46 projecting into recess 43 of tongue 40 and normally assuming a position approximately in the longitudinal center of recess 43. Arranged between transverse member 44 and transverse bars 45 and 46 is, in each case, one of the hydraulic chambers 10 and 12, the walls of which are designed flexibly and compliantly in the manner of a bellows. These chambers communicate with one another via a channel 11, which is formed in housing 42 or is arranged on said housing. Furthermore, hydraulic chambers 10 and 12 are each respectively connected to associated chambers 13 and 14, which have elastically compliant walls and are accommodated in recesses of housing 42.

When ski 1 "flexes," i.e., when the ski ends bend in the upward direction relative to the central region of ski 1, region 40" of tongue 40 is displaced to the left in FIGS. 10 and 11, with the result that hydraulic chamber 12 is compressed and hydraulic chamber 10 is expanded. This results in hydraulic medium trying to escape from hydraulic chamber 12 in the direction of hydraulic chamber 10 and of associated chamber 13, while hydraulic chamber 10 tries to receive hydraulic medium from associated chamber 13 and chamber 12.

When the ski executes a "counterflex," i.e., when the ski ends bend in the downward direction relative to the central region of ski 1, region 40" of tongue 40 is displaced to the right in FIGS. 10 and 11, with the result that the above-mentioned hydraulic flows occur in the opposite direction, since hydraulic chamber 10 is reduced, while hydraulic chamber 12 is expanded.

The presented hydraulic flows can be subjected to control as follows:

According to a particularly preferred embodiment of the present invention, use is made of hydraulic media which have pronounced magnetoviscosity, i.e., become very viscous under the influence of magnetic fields. Channel 11 is enclosed by a coil 22, which, in a manner outlined below, can be provided in a controllable manner with an electric current and thus produces, within channel 11, a magnetic field which can be controlled or switched on and off. Consequently, the hydraulic medium in channel 11 takes on its viscous or low-viscosity form in a controlled manner, with the result that an exchange of hydraulic medium between hydraulic chambers 10 and 12 is made easier or more difficult. This then results in it being difficult or easy to displace region 40" of tongue 40 in the longitudinal direction of the ski, within housing 42, and in bending movements of ski 1 remaining unaffected or only being able to take place counter to a more or less increased resistance.

In a particularly preferred manner, two tongues 40 are arranged such that one tongue is oriented with its region 40" toward the front in the longitudinal direction of the ski, and the other tongue is oriented with said region toward the rear in the longitudinal direction of the ski. In this arrangement, the two tongues can be connected integrally to one another and can be fixed to the ski at a common region 40'. Furthermore, two housings 42, with the hydraulic parts 10 to 14, are then also provided, i.e., in each case one of the housings is assigned to in each case one of the tongues.

High-frequency generator 15 is accommodated in a cavity of one housing 42 or of an additional housing, and said generator provides coils 16 and 17 with a high-frequency electric current. Coils 16 and 17 enclose associated chambers 13 and 14, there being a change in the impedance of the electric current paths between the connections of coils 16 and 17 at high-frequency generator 15 depending on the quantity of hydraulic medium received by associated chambers 13 and 14. These changes in impedance are determined by impedance networks 18 and 19 which, accordingly, pass different signals to associated inputs of electronic processor 20. The latter controls the two electric power stages 21, which each provide one of coils 22 at channels 11 with electric current. Depending on the size of the electric current, coils 22 produce a magnetic field of different strength in channels 11, with the result that the viscosity of the hydraulic medium in channels 11 changes correspondingly, the flow resistance of channels 11 thus also changing. In the case of relatively strong magnetic fields, the hydraulic medium, on account of its magnetoviscosity, becomes so viscous that it can no longer flow through channels 11, or can flow through them only with difficulty. In this manner, the connection between hydraulic chambers 10 and 12 can thus be controlled (e.g., "opened" or "closed"). Accordingly, the depicted system can operate in basically the same manner as in the case of the embodiment of FIG. 1.

When the ski is traveling through a curve, the skier uses the edges, ski 1 bending to a more or less pronounced extent because the centrifugal forces caused by the skier act predominantly in the central region of ski 1. As a result, the ski ends are thus bent in the upward direction relative to the central region of ski 1. As a result of this bending of ski 1, hydraulic chambers 12 are reduced, hydraulic medium being displaced into associated chambers 14, with the result that the impedance of coils 16 is increased. At the same time, hydraulic chambers 10 are increased, hydraulic medium flowing out of associated chambers 13 into chambers 10, with the result that the impedance of coils 17 is reduced. By means of impedance networks 18 and 19, the processor recognizes the above-mentioned hydraulic-medium displacement which is characteristic of flexing of ski. 1. Thereupon, power stages 21 are activated by processor 20 such that they provide coils 22 with a comparatively large electric current and strong magnetic fields take effect in channels 11. Consequently, channels 11 are "closed off" to a more or less pronounced extent by the magnetically caused viscosity of the hydraulic medium, with the result that there can be virtually no exchange of hydraulic medium between hydraulic chambers 10 and 12, and the bending of ski 1 is counteracted by a comparatively strong resistance, i.e., ski 1 is stiffened.

Processor 20 "detects" a counterflex occurring after the ski has traveled through a curve because the impedance of the two coils 17 is then increased, while the impedance of the two coils 16 is reduced. This is based on the fact that, on the one hand, hydraulic medium flows out of hydraulic chambers 10 into associated chambers 13 and, on the other hand, hydraulic medium flows out of associated chambers 14 into hydraulic chambers 12. In order not to obstruct ski 1 from bending back in the desired manner after it has traveled through a curve, processor 20 switches off power stages 21, with the result that the magnetic field of coils 22 is eliminated and the hydraulic medium in channels 11 returns to low-viscosity form again. Accordingly, hydraulic medium can be exchanged between hydraulic chambers 10 and 12 mainly without resistance, and ski 1 bends back essentially without resistance.

When ski 1, traveling quickly straight ahead, glides over an unevenness in the ground, first of all, the front end of ski 1 is deflected vertically, while the rear end of ski 1 only executes a corresponding deflection at a time interval which is dependent on the traveling speed. Here, processor 20 "notes" that the signals of impedance networks 18 and 19 which are assigned to the front ski end and the signals of impedance networks 18 and 19 which are assigned to the rear ski end are the same, but occur with a temporal phase displacement, i.e., are not produced simultaneously. Processor 20 can leave such phase-displaced signals unheeded, i.e., power stages 21 remain switched off, with the result that coils 22 do not produce any magnetic fields and the hydraulic medium in channels 11 remains in low-viscosity form. Accordingly, the bending movements of ski 1, when the latter is traveling straight ahead, remain virtually unaffected.

Similarly, processor 20 can detect when the front and rear ends of the ski are bending simultaneously in opposite directions relative to the central region of the ski, and not alter the bending properties of the ski.

It should be appreciated that the various foregoing arrangements, which are provided to modify bending properties of the ski in order to stiffen the ski and/or damp vibrations of the ski, may be used in combination with one another.

The foregoing description is directed to specific embodiments of the present invention. It should be appreciated that these embodiments are described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

The invention claimed is:

1. For use with a ski having bending properties relating to the stiffness and/or vibrations of the ski, a system for modifying the bending properties of the ski, the ski having a central region, a forward end and a rearward end, said system comprising:

support means for supporting a ski boot on the ski, said support means including:

a longitudinally extending tongue member having a first portion fixed to said ski and at least one free end movable relative to the ski in the longitudinal direction of the ski as the ski bends, impedance means for applying a variable force to the ski relative to said support means by controlling movement of said at least one free end relative to said ski as said ski bends, said force being dependent on the magnitude and spread of the movement of said at least one free end and the ski.

2. A system according to claim 1, wherein said impedance means varies the stiffness of the ski by varying the range of movement of said free end, as said ski bends.

3. A system according to claim 2, wherein said impedance means varies the stiffness of said ski depending upon a travel condition of said ski.

4. A system according to claim 3, wherein said impedance means increases the stiffness of the ski when the ski is traveling through a curve.

5. A system according to claim 1, wherein said impedance means provides a resistance to the movement of said at least one free end relative to said ski.

6. A system according to claim 5, wherein said tongue member has a forward extending free end and a rearward extending free end.

7. A system according to claim 6, wherein said impedance means increases the resistance to the movement of said forward and rearward extending free ends when the forward and rearward ends of the ski simultaneously bend upward relative to the central region of the ski.

8. A system according to claim 5, wherein said impedance means decreases the resistance to the movement of said forward and rearward extending free ends when the forward and rearward ends of the ski simultaneously bend downward relative to the central region of the ski.

9. A system according to claim 5, wherein said impedance means decreases the resistance to the movement of said forward and rearward extending free ends when the forward and rearward ends of the ski move in the same direction relative to the central region of the ski within a predetermined interval of time.

10. A system according to claim 5, wherein the impedance means decreases the resistance to the movement of said ski relative to said forward and rearward extending free ends when the forward and rearward ends of the ski simultaneously bend in opposite directions relative to the central region of the ski.

11. A system according to claim 4, wherein said impedance means comprises at least one pair of changeable-volume fluid spaces fluidically coupled to each other, said fluid spaces changing their volume oppositely during relative movements of said at least one free end and said ski.

12. A system according to claim 11, wherein said system further comprises control means for controlling the exchange of a fluid between said pair of fluid spaces.

13. A system according to claim 12, wherein said control means controls the fluid exchanged between said pair of fluid spaces by controlling the flow of the fluid through a channel connecting said pair of fluid spaces.

14. A system according to claim 11, wherein said fluid is a hydraulic fluid having an electromagnetically controllable viscosity.

15. A system according to claim 14, wherein said impedance means further comprises a channel connecting said pair of fluid spaces.

16. A system according to claim 15, wherein said control means varies the viscosity of said hydraulic fluid in the channel to vary the flow of the hydraulic fluid therethrough.

17. For use with a ski having bending properties relating to the stiffness and/or vibrations of the ski, a system for modifying the bending properties of the ski, the ski having a central region, a forward end and a rearward end, said system comprising:

support means for supporting a ski boot on the ski, said support means including:

a longitudinally extending member having a first portion fixed to said ski and at least one free end movable relative to the ski in the longitudinal direction of the ski as the ski bends, impedance means for providing resistance to movement of said at least one free end relative to said ski as said ski bends, said impedance means comprising at least one pair of changeable-volume fluid spaces fluidically coupled to each other, said fluid spaces changing their volume oppositely during relative movements of said at least one free end and said ski wherein said fluid is a hydraulic fluid having an electromagnetically controllable viscosity.

18. A system according to claim 17, wherein said impedance means further comprises a channel connecting said pair of fluid spaces.

19. A system according to claim 18, and further including control means for controlling the exchange of said fluid between said pair of fluid spaces.

20. A system according to claim 19, wherein said control means varies the viscosity of said hydraulic fluid in the channel to vary the flow of said hydraulic fluid therethrough.

* * * * *